US010210846B1

(12) United States Patent
Bailey, II

(10) Patent No.: US 10,210,846 B1
(45) Date of Patent: Feb. 19, 2019

(54) ACOUSTIC PLATE FOR A STRINGED INSTRUMENT HAVING A SOUNDBOARD

(71) Applicant: Robert Linn Bailey, II, Cedar Park, TX (US)

(72) Inventor: Robert Linn Bailey, II, Cedar Park, TX (US)

( * ) Notice: Subject to any disclaimer, the term of this patent is extended or adjusted under 35 U.S.C. 154(b) by 0 days.

(21) Appl. No.: 15/439,846

(22) Filed: Feb. 22, 2017

Related U.S. Application Data

(60) Provisional application No. 62/299,670, filed on Feb. 25, 2016.

(51) Int. Cl.
*G10D 1/08* (2006.01)
*G10D 3/02* (2006.01)

(52) U.S. Cl.
CPC ..... *G10D 3/02* (2013.01); *G10D 1/08* (2013.01)

(58) Field of Classification Search
USPC ..... 84/291
See application file for complete search history.

(56) References Cited

U.S. PATENT DOCUMENTS 5,333,527 A 8/1994 James et al.
6,060,650 A 5/2000 McPherson
8,450,587 B2 5/2013 McPherson
2002/0066354 A1 6/2002 Schleske
2008/0028910 A1 2/2008 Shellhammer
2013/0255466 A1 10/2013 McPherson
2014/0144306 A1* 5/2014 Seal ..... G10D 1/005 84/291
2015/0059551 A1* 3/2015 Bailey, II ..... G10D 1/08 84/291

* cited by examiner

*Primary Examiner* — Christopher Uhlir
(74) *Attorney, Agent, or Firm* — Quickpatents, LLC; Kevin Prince

(57) ABSTRACT

An acoustic plate for a soundboard of a musical instrument, such as a guitar or other stringed instrument, comprises a front surface, a rear surface, and at least one peripheral edge. A plurality of dimples project away from the rear surface. Each dimple includes a dimple volume accessible from the front surface of the acoustic plate. Preferably each dimple is formed into a cone-shape, and may be of varying heights. An adhesive layer adheres the front surface of the acoustic plate to the inside surface of the soundboard. Such an adhesive layer is preferably comprised of an epoxy resin type of adhesive. As such, with the front surface of the acoustic plate adhered to the inside surface of the soundboard with the adhesive layer, the dimple volume of each dimple defines a sound modification chamber for modifying the sounds produced by the musical instrument.

14 Claims, 3 Drawing Sheets

ACOUSTIC PLATE FOR A STRINGED INSTRUMENT HAVING A SOUNDBOARD

CROSS-REFERENCE TO RELATED APPLICATIONS

This application claims the benefit of U.S. Provisional Patent Application 62/299,670, filed on Feb. 25, 2016, and incorporated herein by reference.

STATEMENT REGARDING FEDERALLY SPONSORED RESEARCH AND DEVELOPMENT

Not Applicable.

FIELD OF THE INVENTION

This invention relates to guitars, and more particularly to a novel guitar sound board.

DISCUSSION OF RELATED ART

Stringed musical instruments, such as guitars, typically include a substantially hollow body having a front soundboard with a sound aperture, and a neck that directs the strings across the front of the soundboard. It is known in the art to modify the internal structure of the body in order to modify the sounds produced by the instrument. For example, U.S. Pat. No. 8,450,587 to McPherson on May 28, 2013 teaches a bracing system for use against the inside surface of the soundboard in a guitar or other musical instrument. However, such a bracing system is complicated to manufacture and install, and does not lend itself well to altering the shape, position, or orientation of the bracing elements in order to produce a differing sound.

Therefore, there is a need for a device that provides suitable sound modification of a musical instrument, and that can be relatively easily and inexpensively manufactured. Such a needed device would further be durable and not prone to wearing out over time. The present invention accomplishes these objectives.

SUMMARY OF THE INVENTION

The present device is an acoustic plate for a soundboard of a musical instrument, such as a guitar or other stringed instrument. The acoustic plate comprises a front surface, a rear surface, and at least one peripheral edge.

A plurality of dimples project away from the rear surface. Each dimple includes a dimple volume accessible from the front surface of the acoustic plate. Preferably each dimple is formed into a cone-shape, and may be of varying heights.

An adhesive layer adheres the front surface of the acoustic plate to the inside surface of the soundboard. Such an adhesive layer is preferably comprised of an epoxy resin type of adhesive.

As such, with the front surface of the acoustic plate adhered to the inside surface of the soundboard with the adhesive layer, the dimple volume of each dimple defines a sound modification chamber for modifying the sounds produced by the musical instrument.

In one embodiment, a plurality of the dimples are aligned generally linearly in a first line and/or a second line that crosses a longitudinal axis of the acoustic plate. In one embodiment the first line and the second line intersect orthogonally, and may intersect along the longitudinal axis at the same intersection point.

In one embodiment, a first cluster of the dimples may be grouped in proximity with each other. A second cluster of the dimples may be grouped in proximity with each other with a gap devoid of dimples defined between each cluster. A third cluster of the dimples may also be grouped around the intersection point of the first line and the second line of the dimples.

The present invention is a device that provides sound modification and softening of a musical instrument. The present device can be relatively easily manufactured and installed during manufacturing of the musical instrument. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
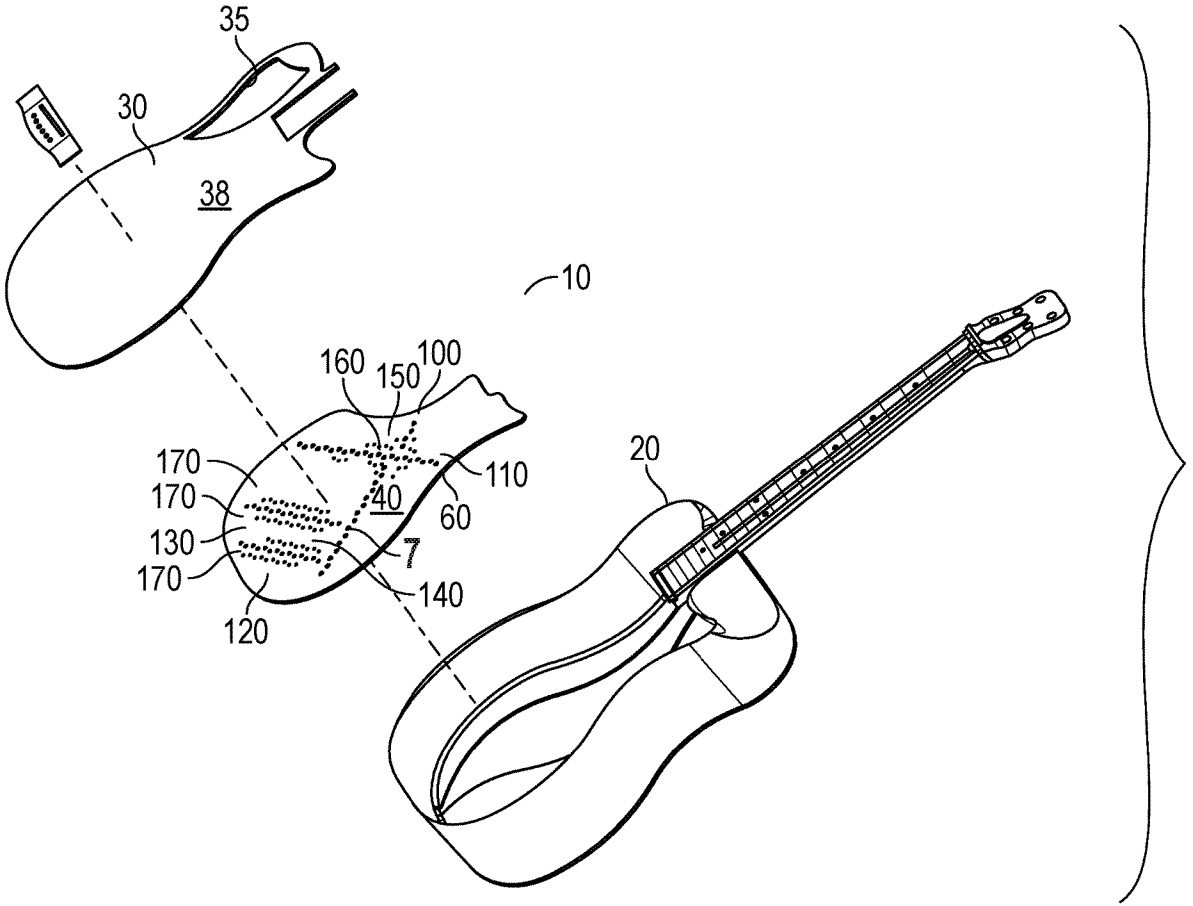
FIG. 1 is an exploded perspective view of the invention as assembled with a musical instrument.
Figure 2:
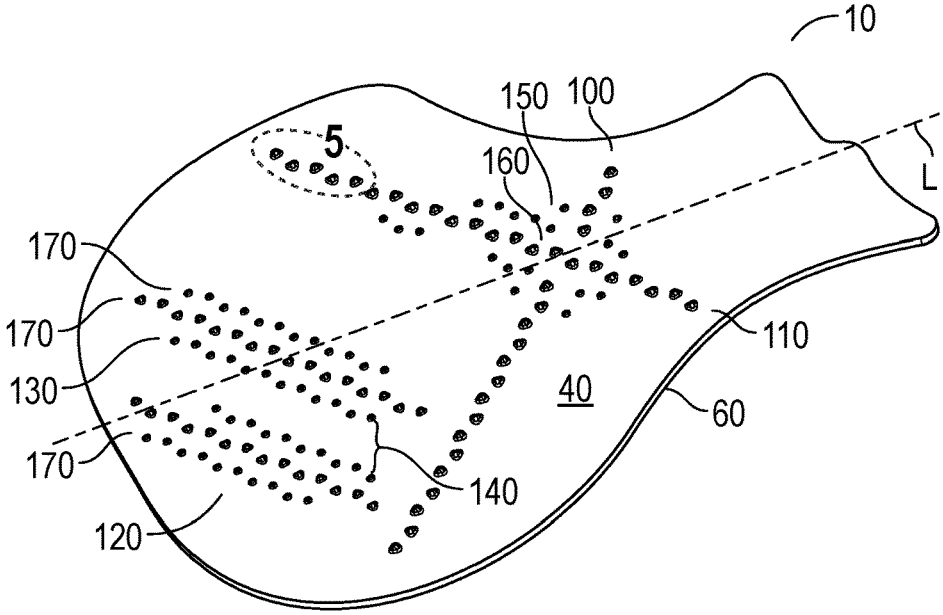
FIG. 2 is a front perspective view of the acoustic plate of the present invention.
Figure 3:
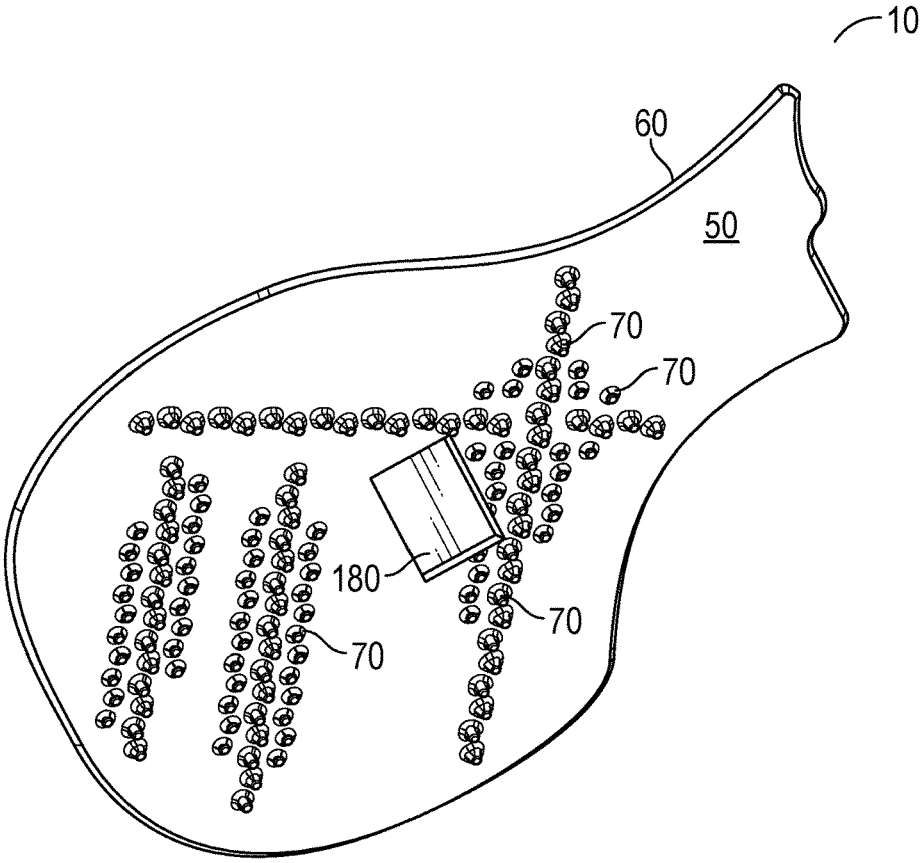
FIG. 3 is a rear perspective view of the acoustic plate of the present invention.

FIGS. 1-3 illustrate an acoustic plate 10 for a soundboard 30 of a musical instrument 20, such as a guitar or other stringed instrument. The soundboard 30 has an outside surface 38, an inside surface 32, and typically at least one sound hold 35 therethrough.

The acoustic plate 10 comprises a front surface 40, a rear surface 50, and at least one peripheral edge 60. Preferably the acoustic plate is made from a carbon fiber composite material, a fiberglass sheet material, or the like.

Figure 4:
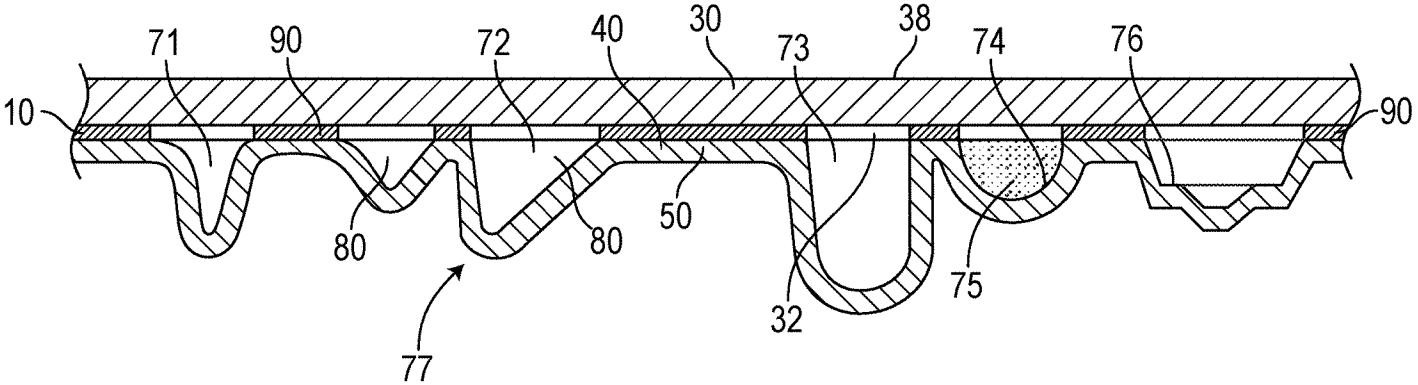
FIG. 4 is a cross-sectional view of the acoustic plate along a line of a plurality of dimples formed into the acoustic plate.

A plurality of dimples 70 project away from the rear surface 60. Each dimple 70 includes a dimple volume 80 accessible from the front surface 40 of the acoustic plate 10. Preferably each dimple 70 is formed into a cone-shape 71 (FIG. 4), and may be of varying heights. Each dimple 70 may be formed by heating the acoustic plate 10 and then squeezing the plate 10 from both the front surface 40 and the rear surface 50 with a pair of metallic molding plates, or the like. The dimple volume 80 may contain air, sound-absorbing foam material 75, or other material as desired for modifying the sound produced by the musical instrument 30.

Figure 5:
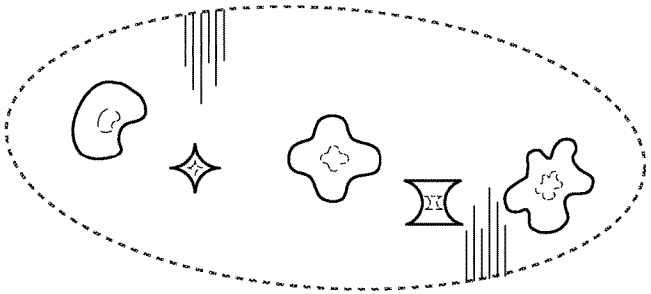
FIG. 5 is an enlarged front perspective view of the acoustic plate of the present invention, taken along line 5-5 of FIG. 2, and illustrating irregular-shaped dimples.

Some or all of the dimples 70 may be alternately take the shape of a polyhedron 72, the base of which has at least three sides, or a partial spheroid 73, or a hemisphere 74. Alternately some or all of the dimples 70 may be globular, bean-shaped, paisley-shaped or otherwise irregularly-shaped (FIG. 5). Further, some or all of the dimples 70 may be formed such that their point 77 of greatest depth is off-center with regard to the opening of the dimple 70 at the front surface 40; that is to say, such dimples 70 may be non-orthogonal to the acoustic plate 10. Some of the dimples 70 may include a step 76. Preferably the shape of each dimple 70 facilitates the removal of the acoustic plate 10 from any tooling or mold surface (not shown).

An adhesive layer 90 adheres the front surface 40 of the acoustic plate 10 to the inside surface 32 of the soundboard 30. Such an adhesive layer 90 is preferably comprised of an epoxy resin type of adhesive.

As such, with the front surface 40 of the acoustic plate 10 adhered to the inside surface 32 of the soundboard 30 with the adhesive layer 90, the dimple volume 80 of each dimple 70 defines a sound modification chamber for modifying the sounds produced by the musical instrument. Sounds produced at the front of the soundboard 30 are dampened by the volume 80 of air or foam or the like to soften the sounds produced by the musical instrument 20.

In one embodiment, a plurality of the dimples 70 are aligned generally linearly in a first line 100 and/or a second line 110 that crosses a longitudinal axis L of the acoustic plate 10. In one embodiment the first line 100 and the second line 200 intersect orthogonally, and may intersect along the longitudinal axis L (FIG. 2) at the same intersection point 160.

In one embodiment, a first cluster 120 of the dimples 70 may be grouped in proximity with each other (FIGS. 2 and 3). A second cluster 130 of the dimples 70 may be grouped in proximity with each other with a gap 140 devoid of dimples 70 defined between each cluster 120,130. A third cluster 150 of the dimples 70 may also be grouped around the intersection point 160 of the first line 100 and the second line 110 of the dimples 70.

The dimples 70 of the first cluster 120 and of the second cluster 130 may comprise a number of rows 170, such as three rows 170, the rows 170 being mutually parallel. Likewise, the second cluster 130 of the dimples 70 may comprise three of the parallel linear rows 170 of the dimples 70. In one embodiment, the rows 170 of both the first cluster 120 and the second cluster 130 are all mutually parallel.

While a particular form of the invention has been illustrated and described, it will be apparent that various modifications can be made without departing from the spirit and scope of the invention. For example, clearly other configurations of dimple clusters, lines, patterns or the like could be utilized with such an acoustic plate 10. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An acoustic plate for a musical instrument soundboard of the type comprising an outside surface, an inside surface, and at least one sound hole therethrough, the acoustic plate comprising:

a front surface, a rear surface, and at least one peripheral edge;

a plurality of dimples projecting away from the rear surface, each dimple including a dimple volume accessible from the front surface of the acoustic plate, a first cluster of the dimples being grouped in proximity with each other and a second cluster of the dimples being grouped in proximity with each other, a gap devoid of dimples being defined between each cluster;

an adhesive layer adapted to adhere the front surface of the acoustic plate to the inside surface of the soundboard;

whereby with the front surface of the acoustic plate affixed with the inside surface of the soundboard with the adhesive layer, the dimple volume of each dimple produces a sound modification chamber for modifying sounds of the musical instrument.

2. The acoustic plate of claim 1 wherein each dimple is generally cone-shaped.

3. The acoustic plate of claim 1 wherein each dimple is a polyhedron in shape, the base of which has at least three sides.

4. The acoustic plate of claim 1 wherein each dimple is a partial spheroid in shape.

5. The acoustic plate of claim 1 wherein each dimple is hemispherical in shape.

6. The acoustic plate of claim 1 wherein a plurality of the dimples are aligned generally linearly in a first line that crosses a longitudinal axis of the acoustic plate.

7. The acoustic plate of claim 6 wherein a plurality of the dimples are aligned generally linearly in a second line that crosses the longitudinal axis of the acoustic plate and the first line.

8. The acoustic plate of claim 7 wherein the first line and second line of dimples are generally orthogonal.

9. The acoustic plate of claim 1 wherein the dimples do not all project away from the rear surface by the same height.

10. The acoustic plate of claim 1 wherein a third cluster of dimples is grouped around an intersection where a first and a second line of dimples cross.

11. The acoustic plate of claim 7 wherein the first and second line of dimples and the longitudinal axis of the acoustic plate all intersect together.

12. The acoustic plate of claim 1 wherein the first cluster of dimples comprises three parallel linear rows of the dimples.

13. The acoustic plate of claim 12 wherein the second cluster of dimples comprises three parallel linear rows of the dimples.

14. The acoustic plate of claim 13 wherein the rows of the first and second clusters of dimples are all mutually parallel.

* * * * *